US008695138B2

(12) United States Patent
Pelton

(10) Patent No.: US 8,695,138 B2
(45) Date of Patent: Apr. 15, 2014

(54) FOLDING SURVIVAL KNIFE WITH INTEGRATED TOOLS

(75) Inventor: Robert Young Pelton, Bonsall, CA (US)

(73) Assignee: DPX Ventures Limited, Ras Al Khaimah (AE)

( * ) Notice: Subject to any disclaimer, the term of this patent is extended or adjusted under 35 U.S.C. 154(b) by 273 days.

(21) Appl. No.: 13/312,965

(22) Filed: Dec. 6, 2011

(65) Prior Publication Data

US 2013/0139324 A1 Jun. 6, 2013

(51) Int. Cl.
*B26B 1/00* (2006.01)
*B26B 1/04* (2006.01)
*B26B 11/00* (2006.01)

(52) U.S. Cl.
CPC ..... *B26B 1/00* (2013.01); *B26B 11/006* (2013.01)
USPC ..... 7/118; 30/161

(58) Field of Classification Search
USPC ..... 7/118, 158; 30/123, 127, 136, 142, 161
See application file for complete search history.

(56) References Cited

U.S. PATENT DOCUMENTS

| | | | |
|---|---|---|---|
| 1,455,621 | A | 5/1923 | Joyner |
| 2,315,898 | A | 4/1943 | Krilow |
| D141,321 | S | 5/1945 | Gallagher |
| 2,440,485 | A | 4/1948 | Ranseen |
| D169,490 | S | 5/1953 | Hug |
| D169,797 | S | 6/1953 | Wallace |
| 2,951,482 | A | 9/1960 | Sullivan |
| D224,388 | S | 7/1972 | Wood |
| 3,760,438 | A | 9/1973 | White |
| D230,696 | S | 3/1974 | Evrell et al. |
| D245,830 | S | 9/1977 | De Gross |
| 4,363,147 | A | 12/1982 | Deweese |
| 4,442,559 | A | 4/1984 | Collins |
| 4,553,279 | A | 11/1985 | Gassew et al. |
| 4,578,864 | A | 4/1986 | Hoffman |
| 4,622,707 | A | 11/1986 | Finn |
| D288,895 | S | 3/1987 | Sarnoff et al. |
| 4,669,140 | A | 6/1987 | Miceli |
| 4,817,221 | A | 4/1989 | Ryan |
| 4,821,356 | A | 4/1989 | Finn |
| D308,009 | S | 5/1990 | Evrell |
| 5,259,281 | A | 11/1993 | Burke |
| D369,287 | S | 4/1996 | Seber et al. |
| 5,511,310 | A | 4/1996 | Sessions et al. |

(Continued)

FOREIGN PATENT DOCUMENTS

| | | | |
|---|---|---|---|
| DE | 10130178 | A1 | 1/2003 |
| DE | 202009001850 | U1 | 12/2009 |

OTHER PUBLICATIONS

Blackwater Aculus Limited Edition Knife. Http://www.dpxgear.com/shop/aculus-coming-soon.html, Jun. 2, 2013.

(Continued)

*Primary Examiner* — David B Thomas
(74) *Attorney, Agent, or Firm* — Arc IP Law, PC; Joseph J. Mayo

(57) ABSTRACT

A folding survival knife that includes structural elements to implement any combination of a bottle opener/pan holder/quick opening feature, wire breaker/choil, jimping/wire strippers, hex nut driver/lashing point, pry bar/scraper, glass breaker in a single blade configuration.

23 Claims, 13 Drawing Sheets

(56) References Cited

U.S. PATENT DOCUMENTS

| | | | | |
|---|---|---|---|---|
| D371,289 | S | 7/1996 | Huang | |
| D371,820 | S | 7/1996 | Thompson | |
| 5,596,808 | A | 1/1997 | Lake et al. | |
| 5,642,567 | A | 7/1997 | Lin | |
| 5,657,543 | A * | 8/1997 | Collins | 30/367 |
| D383,370 | S | 9/1997 | Chen et al. | |
| D385,471 | S | 10/1997 | Seber et al. | |
| 5,727,319 | A * | 3/1998 | Myerchin et al. | 30/123 |
| 5,727,325 | A | 3/1998 | Mussell | |
| D393,405 | S | 4/1998 | Seber et al. | |
| D398,211 | S | 9/1998 | Howard | |
| 6,009,581 | A | 1/2000 | Davis et al. | |
| 6,009,582 | A | 1/2000 | Harrison et al. | |
| 6,009,584 | A | 1/2000 | Padden | |
| D422,669 | S | 4/2000 | Elishewitz | |
| D425,389 | S | 5/2000 | Elishewitz | |
| 6,085,620 | A * | 7/2000 | Anderson et al. | 81/440 |
| D435,409 | S | 12/2000 | Roberts | |
| D442,461 | S | 5/2001 | Glesser | |
| D446,571 | S | 8/2001 | Frazer | |
| 6,318,218 | B1 | 11/2001 | Anderson et al. | |
| D452,123 | S | 12/2001 | Kelleghan | |
| 6,347,875 | B1 | 2/2002 | Painsith | |
| D473,917 | S | 4/2003 | Carter | |
| 6,574,816 | B2 | 6/2003 | Yu Chen | |
| D479,970 | S | 9/2003 | Hutchinson | |
| 6,782,576 | B1 | 8/2004 | Valencic et al. | |
| D496,425 | S | 9/2004 | Carter | |
| D497,531 | S | 10/2004 | Carter | |
| D508,194 | S | 8/2005 | Carter | |
| 6,957,466 | B2 | 10/2005 | Rivera | |
| D515,654 | S | 2/2006 | Trbovich, Jr. | |
| D519,185 | S | 4/2006 | Carter | |
| D520,825 | S | 5/2006 | Kelleghan | |
| D523,317 | S | 6/2006 | Ryan et al. | |
| D527,788 | S | 9/2006 | Kellgren | |
| D536,593 | S | 2/2007 | Fraga | |
| D553,467 | S | 10/2007 | Ryan | |
| D553,468 | S | 10/2007 | Freeman | |
| 7,302,760 | B2 | 12/2007 | Lake | |
| D563,755 | S | 3/2008 | Wu | |
| 7,337,486 | B2 | 3/2008 | Tsuda et al. | |
| 7,360,267 | B2 | 4/2008 | Quenzi | |
| 7,415,745 | B2 | 8/2008 | Rivera | |
| D599,640 | S | 9/2009 | Yang-Fu | |
| D599,641 | S | 9/2009 | Yang-Fu | |
| D600,090 | S | 9/2009 | Yang-Fu | |
| D609,992 | S | 2/2010 | Delaney | |
| 7,676,932 | B2 | 3/2010 | Grice et al. | |
| D614,933 | S | 5/2010 | Freeman | |
| D624,386 | S | 9/2010 | van Deursen | |
| 7,818,843 | B2 | 10/2010 | Kinskey et al. | |
| D632,154 | S | 2/2011 | Yang-Fu | |
| D634,174 | S | 3/2011 | Ryan et al. | |
| 7,913,398 | B2 | 3/2011 | Chu | |
| D639,632 | S | 6/2011 | Freeman et al. | |
| D642,888 | S | 8/2011 | Port et al. | |
| D653,520 | S | 2/2012 | Chang | |
| D654,343 | S | 2/2012 | Wu | |
| D672,841 | S | 12/2012 | Pelton | |
| D672,842 | S | 12/2012 | Pelton | |
| D675,897 | S | 2/2013 | Wu | |
| D677,551 | S | 3/2013 | Pelton | |
| D679,975 | S | 4/2013 | Pelton | |
| 8,464,382 | B2 * | 6/2013 | Chu | 7/118 |
| 2006/0027645 | A1 | 2/2006 | Granick | |
| 2007/0245497 | A1 * | 10/2007 | Tsuda et al. | 7/120 |
| 2008/0222895 | A1 | 9/2008 | Marfione et al. | |
| 2008/0271257 | A1 | 11/2008 | Frazer | |
| 2009/0000038 | A1 | 1/2009 | Padden | |
| 2010/0299933 | A1 | 12/2010 | Vellekamp | |
| 2012/0017443 | A1 | 1/2012 | Hao | |
| 2012/0204353 | A1 * | 8/2012 | Chu | 7/118 |

OTHER PUBLICATIONS

CRKT Columbia River Knife and Tool's Exitool 9030 Multi Tool, retrieved from http://www.amazon.com/Columbia-River-Knife-Exitool-9030/dp/B0030IV8TG on Jul. 24, 2012, 6 pages.

Boker Plus Credit Card Knife 2-¼" Blade, retrieved from http://www.Knifecenter.com on Jul. 24, 2012, 2 pages.

The Original Dog Tag Knife, Titanium Blade, Black Rubber Frame, retrieved from http://www.knifeworks.com/theoriginaldogtagknifetitaniumblade.aspx on Jul. 24, 2012, 4 pages.

Iain Sinclair, CardSharp 2, retrieved from http://iainsinclair.com/products.php on Jul. 24, 2012, 1 page.

SE MT908 11 Function Credit Card Size Survival Pocket Tool, retrieved from http://www.amazon.com/SE-MT908-Function-Credit-Survival/dp/B000Q06L14 on Jul. 24, 2012, 6 pages.

ICE Companion with Lens/Compass—Translucent, retrieved from http://www.sogshopping.com/tools/icc1-12.html?SID=pp1bedicbg7qm82okgt771acd6 on Jul. 24, 2012, 1 page.

Survival Card w/ Fire Starter/Compass—Charcoal, retrieved from http://www.toollogic.com/tools/svc1-38.html on Jul. 24, 2012, 1 page.

DPx HEST 2.0 Knife Survival Blade, http://www.bladehq.com/item--ESEE-DPx_HEST-Folder--6996, downloaded Sep. 26, 2012.

Sheffield Moab Folding Rescue Knife, http://www.autogeek,net/sheffield-rescue-knife.html, downloaded Sep. 27, 2012.

Ontario Hest Original Fixed Blade. Downloaded from http://www.sears.com/ontario-hest-origina-fixed-blade/p-SPM6596962201?prdNo=2&bl . . . on Nov. 16, 2012.

Extended European Patent Search, dated Mar. 15, 2013, 5 pages.

"Microtech Troodon Double Edge OTF Knife, Beadblast Plain Edge, 138-7" BladeOps, LLC, 2 pages.

CRKT "ExiTool—Designed by Russ Kommer", Columbia River Knife & Tool Inc., 3 pages.

* cited by examiner

FOLDING SURVIVAL KNIFE WITH INTEGRATED TOOLS

BACKGROUND OF THE INVENTION

1. Field of the Invention

One or more embodiments of the invention are related to the field of knives. More particularly, but not by way of limitation, embodiments of the invention implement a folding survival knife with integrated tools that may include a bottle opener/pot lifter/quick opening feature, wire breaker/choil, jimping/wire strippers, hex nut driver/lashing point, pry bar/scraper, glass breaker. Embodiments may be constructed from materials that can withstand hostile environments.

2. Description of the Related Art

Standard knives generally include a long, yet thin blade with a handle. The blade generally includes one cutting edge, and an opposing non-cutting edge. Some knives have cutting edges on both sides of the blade. Knives also are built in folding varieties and generally have a pivot on one or both ends of the handle. However, most knives are non-folding and have one cutting edge. Folding knives are generally more portable and tend to enclose the sharp cutting edge of the knife when folded for safety reasons. Some folding knives include multiple types of blades including saws, can openers, screw drivers, and other tools, but generally only provide one function per blade or only provide cutting blades that have no other function.

Hunting knives generally include thicker and hence more robust blades than standard knives and may include and cross-guards to protect the hand while cutting. Survival knives came into service during World War II and evolved during the Viet Nam war to include serrations on the top portion of the knife blade. The serrations could be used to cut through the fuselage of aircraft to rescue crewmen for example.

Modern survival knives are limited in the number of functions they provide since the number of elements utilized to create a survival knife is limited to a blade, optionally with serrations and a handle. There are no known survival knives that include a single robust blade configuration of a survival knife with structural elements on the single blade or frame such as a bottle opener/pot lifter/quick opening feature, wire breaker/choil, jimping/wire strippers, hex nut driver/lashing point, pry bar/scraper, glass breaker.

Generally, survivalists and military personnel in hostile or hazardous environment carry a multitude of other tools along with a survival knife. In minimalistic survival scenarios, carrying a multitude of tools is not possible. In such hostile environments, life may depend on having a survival tool such as a knife that is robust and capable of performing other functions. For at least the limitations described above there is a need for a folding survival knife with integrated tools.

BRIEF SUMMARY OF THE INVENTION

One or more embodiments described in the specification are related to a folding survival knife with integrated tools. Embodiments of the invention include a knife blade that is highly durable with a thick top cross section. This thick top enables the blade to endure being struck when using the knife blade as a wood splitting wedge.

An indentation on the top of the blade enables a bottle cap opener, and also enables use of the knife as a pot lifter. The indentation can also be used in combination with an indentation on the cutting edge of the blade as lashing points to enable the blade to be utilized as a spear, axe or dead drop trap when lashing the blade to a pole for example. In addition, the indentation can be used as an aid for quickly opening the blade when the indentation catches on the inside of a pocket for example.

The indentation on the cutting edge of the blade enables a wire breaker. This indentation is also known as the wire break notch. The wire break notch is situated near the handle and also acts as a "choil" that allows sharpening for the entire blade length. The wire break notch may be aligned to indent towards the bottle cap opener indentation and visa versa so that the top and bottom indentations cooperate in the lashing configuration.

Jimping slots on the top of the blade near the handle enable thumb contact with the blade that provides better control. In addition, the jimping slots generally vary in size so that they can be used as wire strippers and for different diameters of wire insulation.

One or more hexagonal hole may be included on the blade or frame. Each hexagon hole enables the knife to be utilized as a hex nut wrench. The hexagonal hole may also be located in the center portion of the frame near the blade or in the rear portion of the frame, furthest way from the tip. Locating the hexagonal hole on the frame allows the knife to be utilized as a wrench in the open or folded configuration. In one or more embodiments, the hexagonal hole or frame may be magnetized to hold bits. If more than one hexagonal hole is implemented, then different sizes of hexagonal holes may be provided. In one or more embodiments, square or other shape holes may be provided in the blade or frame to enable the embodiments to rotate any type of nut or connector element.

Lashing points may also be implemented as holes in the blade or frame. Lashing points may be located anywhere on the knife as desired. In one or more embodiments, the lashing points may be placed anywhere on the knife blade or frame or anywhere else that does not comprise strength. In addition, the hexagonal hole(s), bottle opener, jimping slots and wire breaker may also be utilized to lash the knife frame to another object.

One or more embodiments include a projection from the frame than enables a pry bar. The pry bar may be located anywhere on the knife, including near the butt of the knife In one embodiment, the projection points at about a right angle from the frame in the same direction as the cutting edge points with respect to the flat top of the blade. This configuration enables the rear portion of the frame to be struck to drive the pry bar into an object or between two objects to separate them. For example, the pry bar may be utilized in lieu of the blade, to split open objects, remove staples, chisel rock or ice or any other material instead of using and potentially damaging the blade. In other embodiments, the pry bar may point away from the handle or frame at any other angle. In addition, the projection may be utilized in any other manner, such as a chisel or pick or for any other purpose. Embodiments of the projection may take any shape so long as they project away from the handles or frame or spacer.

Embodiments may be folded to provide a shorter overall length format for carrying in pockets for example and may rotate about a pivot between the blade and handle. Embodiments may utilize any type of folding mechanism including automatic, assisted, quick opening, spring assisted or manual and may include any type of locking mechanism as is utilized to describe an exemplary embodiment herein.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION OF THE INVENTION

A folding survival knife with integrated tools will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

Figure 1:
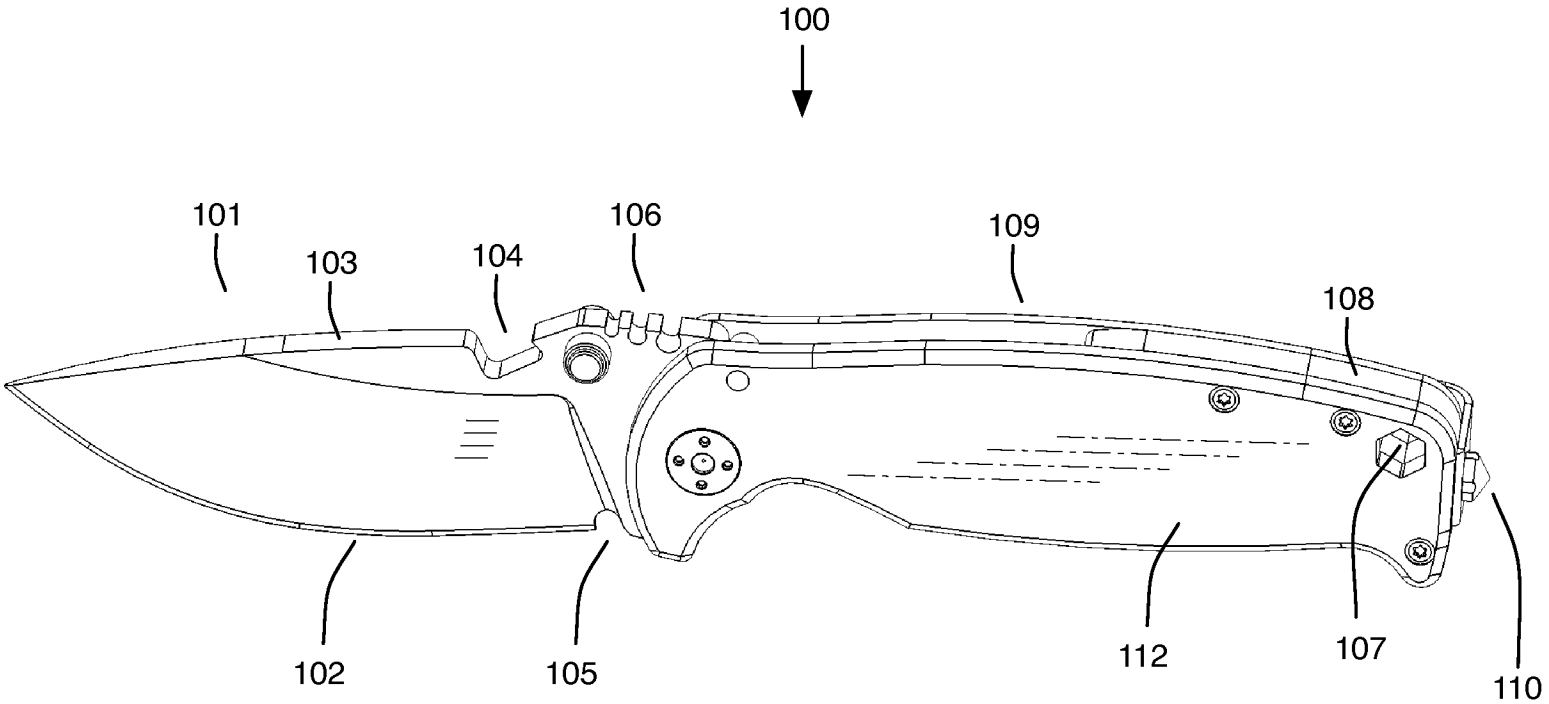
FIG. 1 illustrates a perspective left side view of an embodiment of the invention.

FIG. 1 illustrates a perspective view of an embodiment of the invention 100. The distal end of blade 101 is shown in the leftmost portion of the figure. Blade 101 has two substantially flat faces, one that is visible as shown between cutting edge 102 and non-cutting edge 103 having a flat top, the other flat face is on the opposite side of the blade and which is visible in FIG. 3. Cutting edge 102 is situated on a first side of blade 101 where the two substantially flat faces meet at the bottom portion of the blade as shown. Cutting edge 102 may also include serrated portions depending on the intended environment or application. Non-cutting edge 103 includes a flat top that is located on a second side of the blade opposite the cutting edge as shown.

Non-cutting edge 103 includes a first indentation 104 that extends toward cutting edge 102 of the blade. In one or more embodiments of the invention, indentation 104 includes a first and second wall that both slant down and back away from the distal end of the blade. The first and second wall may be any shape including linear or curved. The first and second walls meet at the inner most portion of indentation 104. The innermost portion of indentation 104 may also be liner or curved. Generally, the second wall provides a hook like area to pry a bottle cap as the first wall rests on top of the bottle cap. First indentation 104 is configured to engage a bottle cap on a top side of the bottle cap with a first portion of the first indentation, for example the left side of the indentation as shown, and also configured to engage a bottom edge of the bottle cap with an opposing side of the first indentation, for example the right side of the indentation as shown, to enable removal of the bottle cap. The depth of indentations 104 may be any depth deep enough and wide enough to remove a bottle cap. In addition, indentation 104 may also be utilized as a pot lifter wherein opposing sides of the indentation may be utilized to lift a hot pot by the handle, or on the edge of a pan to lift the pan. In folding versions of the knife, the indentation provides an element to catch on the edge of a pocket, for example to initiate quick opening, e.g., rotation of the blade with respect to the frame that begins the process of opening the knife. In this manner, only one hand is utilized to grab and open the knife. In one or more embodiments, the flat top at non-cutting area 103 is greater than ⅛ of an inch, or at least 3/16 of an inch wide or any other dimension thicker than a standard knife. This enables the knife to be utilized as a wedge or splitter, to split wood for example. The wide flat top may be struck with a hammer or rock for example without breaking the blade.

Cutting edge 102 generally includes a second indentation 105 configured to engage a wire to enable lateral angular movement of the blade to break the wire. Second indentation 105 is referred to as a wire breaker. Second indention 105 effectively constitutes a "choil", i.e., an unsharpened area of the knife-edge. The second indentation includes a flat portion that is not sharp in one or more embodiments, for example in the innermost portion of the indentation.

In one or more embodiments of the invention, the first indentation, i.e., bottle cap opener, and second indentation, i.e., the wire breaker are indented toward one another to enable the blade to be lashed to another object, such as a stick, with a line wrapped around the stick and within the first indentation and the second indentation. In this manner it is possible to use the knife as a spear, axe or dead drop trap.

In one or more embodiments of the invention, non-cutting edge 103 further comprises jimping 106 configured to provide a thumb grip on the non-cutting edge wherein the jimping is configured as two or more indentations of different size configured to grip wire insulation of different gauge to enable lateral translation movement of the blade to remove the wire insulation.

Embodiments of the invention include a spacer, generally shown to the right of the knife and which holds handle 112 to locking handle 109 at a fixed distance from one another. The handle and locking handle are also held at substantially the same distance by the thickness rotational element about which the blade rotates as will be described.

One or more embodiments of the invention include hexagonal hole 107 through the spacer, handle and locking handle or any other portion of the knife. The hexagonal hole for example is configured to engage a hex nut to enable rotation of the hex nut. The hexagonal size may be of any desired dimension depending on the desired application. Alternatively, the hexagonal hole may be located on the blade. In other embodiments, hexagonal hole 107 may be implemented as two or more different sized holes if desired. The hexagonal hole may be located for example near a distal end of the handle area.

One or more embodiments of the invention include first pointed projection 110 coupled with the distal end of the spacer that extends substantially parallel to the longest axis of the handle. The first pointed projection is known as a "glass breaker" and is configured break glass when struck against glass. In one or more embodiments of the invention, the glass breaker may be implemented as a conical projection that ends in a point or line or curve for example. In one or more embodiments, the first pointed projection is removably coupled to the spacer.

Figure 2:
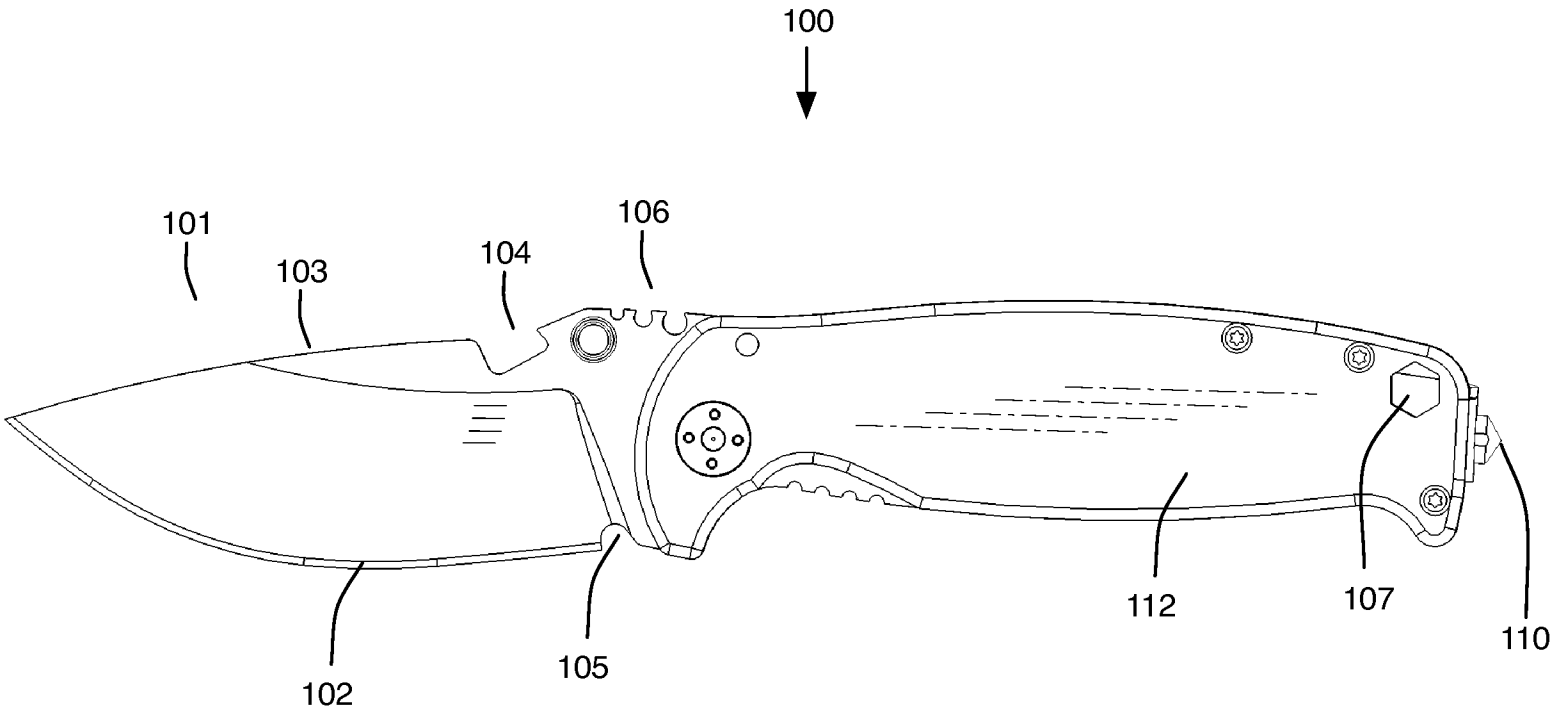
FIG. 2 illustrates a left side view of an embodiment of the invention.

Embodiments may be constructed from any type of rugged material for the blade, frame and optional handles. Embodiment may be implemented with a blade made from 1095 Carbon steel, or Milspec black coated D2 tool steel or SLEIPNER® tool steel, Niolox, ELMAX®, or any other material having a flat top thickness of nearly 0.2 inches or more and 3 inch cutting edge or in any other dimensions. In this embodiment, the knife weighs about 5 ounces and has a full length of 7.6 inches. Handles may be made from any material including wood or canvas such as MICARTA®, or fiberglass based laminates such as G10 or FR-4. Other embodiments, may utilize titanium for the spacer or other components or any other material depending on the intended application. FIG. 2 illustrates a left side view of an embodiment of the invention.

Figure 3:
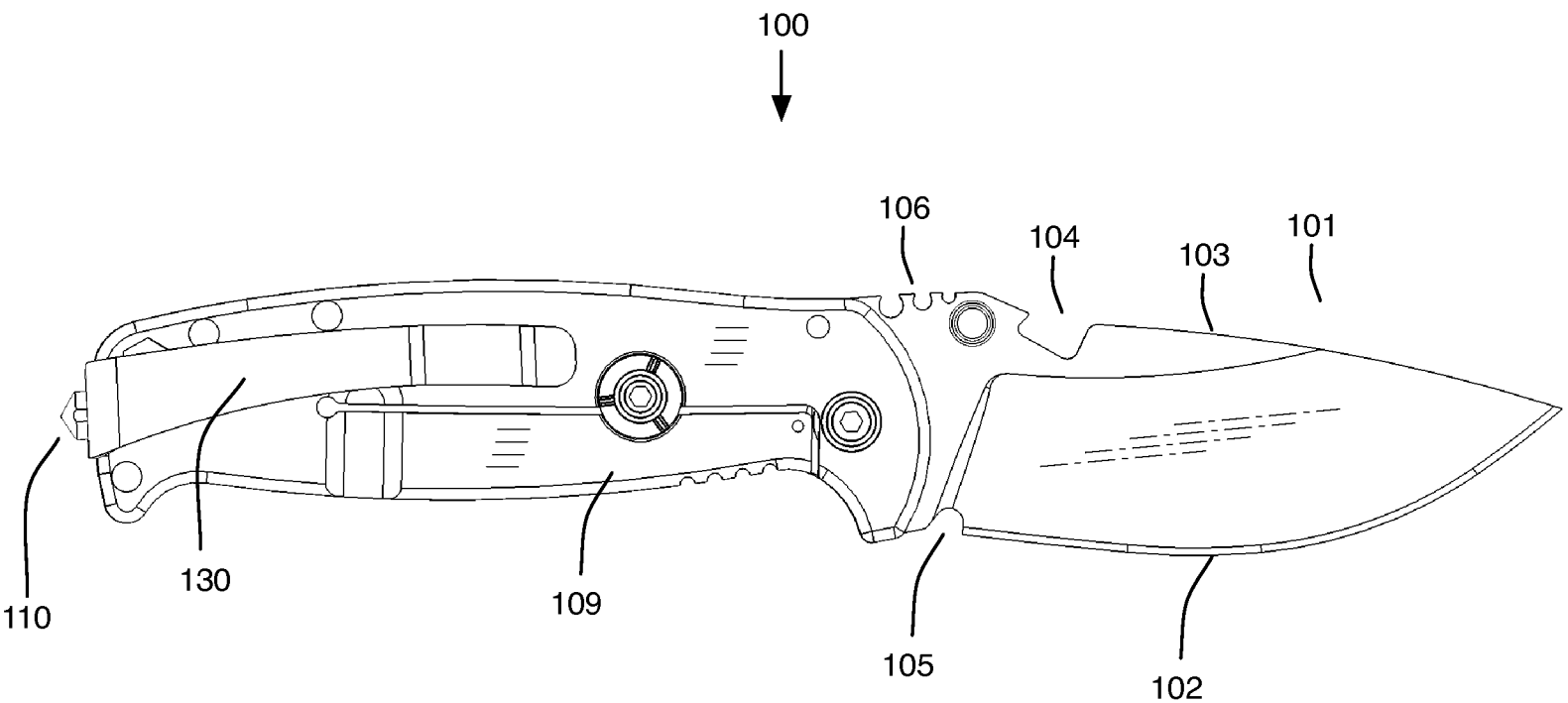
FIG. 3 illustrates a right side view of an embodiment of the invention.

FIG. 3 illustrates a right side view of an embodiment of the invention. Locking handle 109 and optional pocket clip 130 are visible in this figure. Locking handle 109 has a locking element that may spring toward the center portion of the blade and lock the blade in place until the locking element is pushed outwardly, i.e., out of the page as shown to enable rotation of the blade to the folded position. Pocket clip 130 is optional and allows for clipping the knife to a pocket or any other item such as a belt for example. Pocket clip 130 may be located over locking handle 109 to provide a limit of travel on locking handle 109 so that locking handle 109 does not extend outward past a desired distance. In one or more embodiments, pocket clip 130 rests on locking handle 109 and is bendable and also provides inward force when the knife is gripped to ensure that locking handle 109 engages the lower locking portion of the blade.

Figure 4:
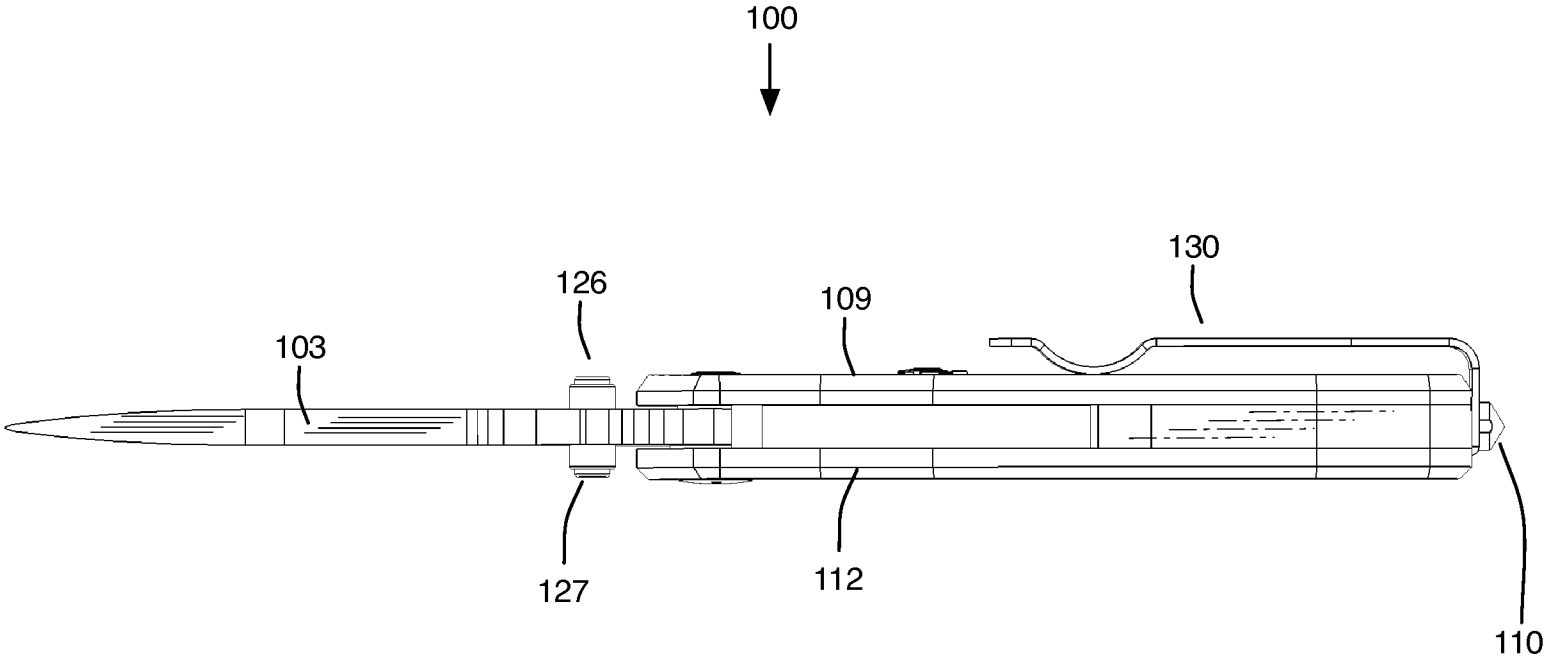
FIG. 4 illustrates a top view of an embodiment of the invention.
Figure 5:
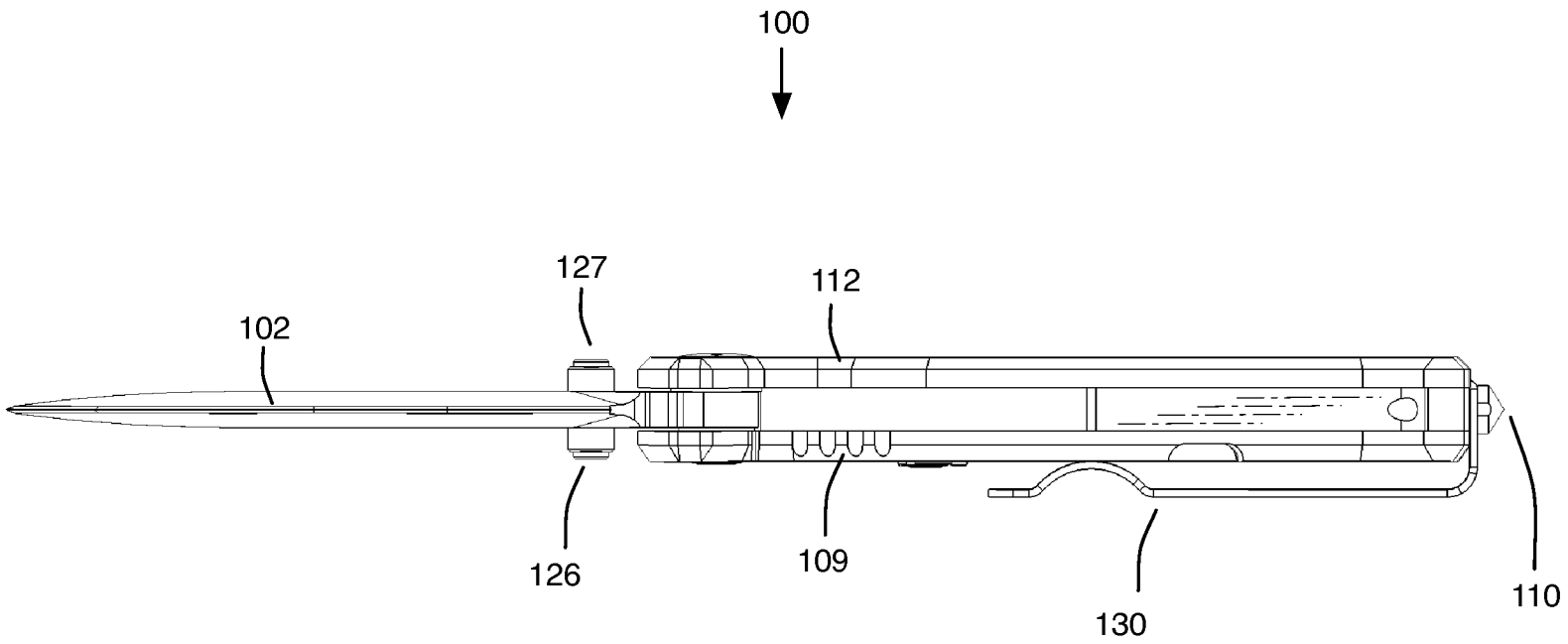
FIG. 5 illustrates a bottom view of an embodiment of the invention.
Figure 7:
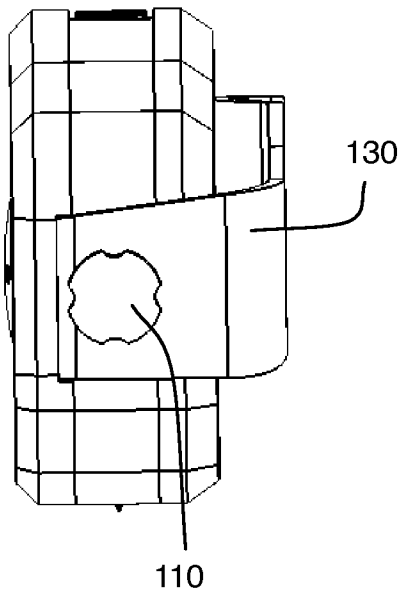
FIG. 7 illustrates a rear view of an embodiment of the invention.
Figure 6:
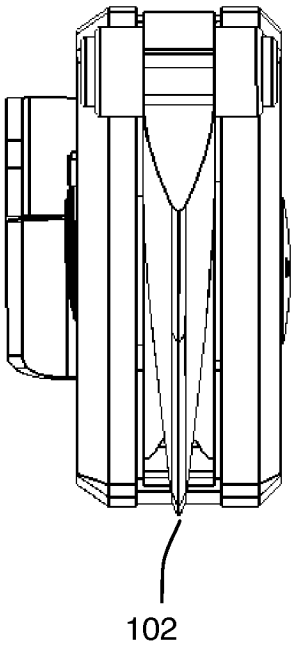
FIG. 6 illustrates a front view of an embodiment of the invention.

FIG. 4 illustrates a top view of an embodiment of the invention. As shown, first and second thumb opener 126 and 127 enable thumb assisted opening of the blade. Handle 112 may include a hidden compartment and may separated in any manner to access contents thereof. In one or more embodiments, an inner portion of the handle may be flat while the outer portion has an internal indentation for hiding items. Any other component of the knife may be utilized for a hidden compartment so long as the component may be formed with an internal space. FIG. 5 illustrates a bottom view of an embodiment of the invention. FIG. 6 illustrates a front view of an embodiment of the invention. FIG. 7 illustrates a rear view of an embodiment of the invention.

Figure 8:
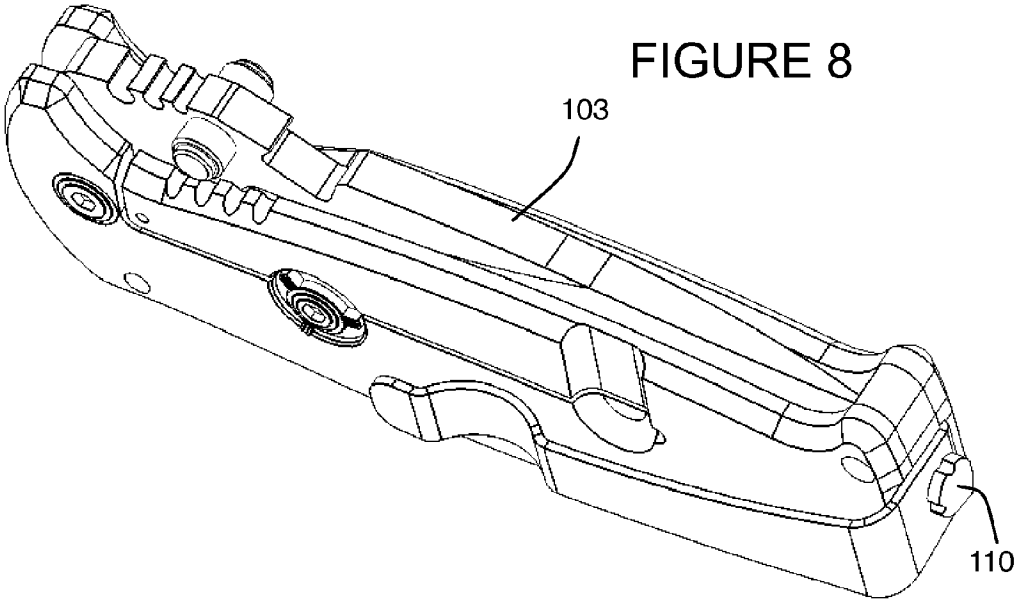
FIG. 8 illustrates a perspective view of an embodiment of the invention in the folded configuration.
Figure 10:
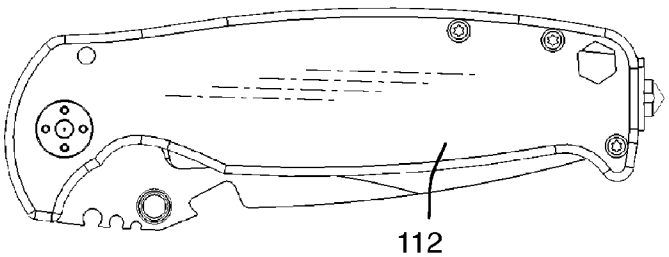
FIG. 10 illustrates a left side view of an embodiment of the invention in the folded configuration.
Figure 9:
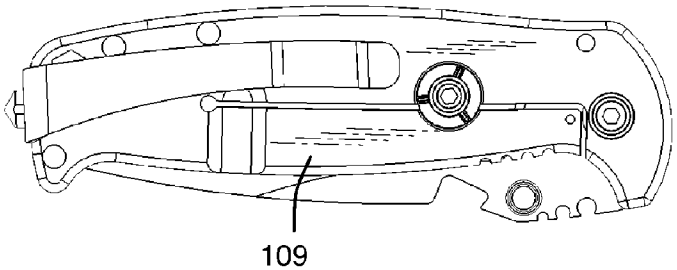
FIG. 9 illustrates a right side view of the an embodiment of the invention in the folded configuration.

FIG. 8 illustrates a perspective view of an embodiment of the invention in the folded configuration. As shown, top face 103 of the blade is exposed while the cutting edge is tucked into the inner space provided by the spacer that holds the handle and locking handle apart. FIG. 9 illustrates a right side view of an embodiment of the invention in the folded configuration. FIG. 10 illustrates a left side view of an embodiment of the invention in the folded configuration.

Figure 11:
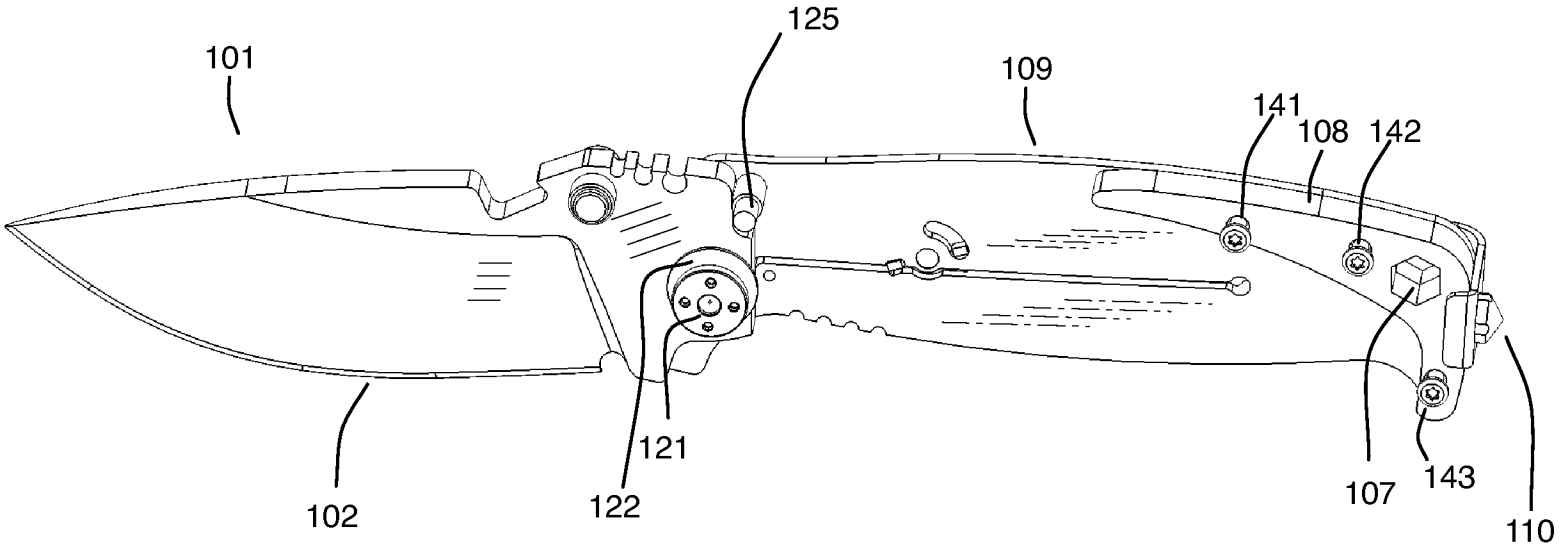
FIG. 11 illustrates a perspective left side view of an embodiment of the invention without the handle to show the internal components of the knife.

FIG. 11 illustrates a perspective left side view of an embodiment of the invention without the handle to show the internal components of the knife. Stop pin 125 engages an upper rear portion of blade 101 to limit the total rotation of the blade to approximately parallel to the longest axis of the handle. The stop pin also maintains the spacing between the handle and locking handle at the upper blade area. Pivot nut 121 enables tension of the blade rotation to be set by rotating pivot nut 121 which is threaded and engages a pivot bolt on the other side of the knife as is shown in the next figure. First washer 122 lies between the handle and blade 101 and may be made of any material such as bronze or nylon or any other material. Spacer 108 provides holes for screws 141, 142 and 143 to hold the handle to spacer 108.

Figure 12:
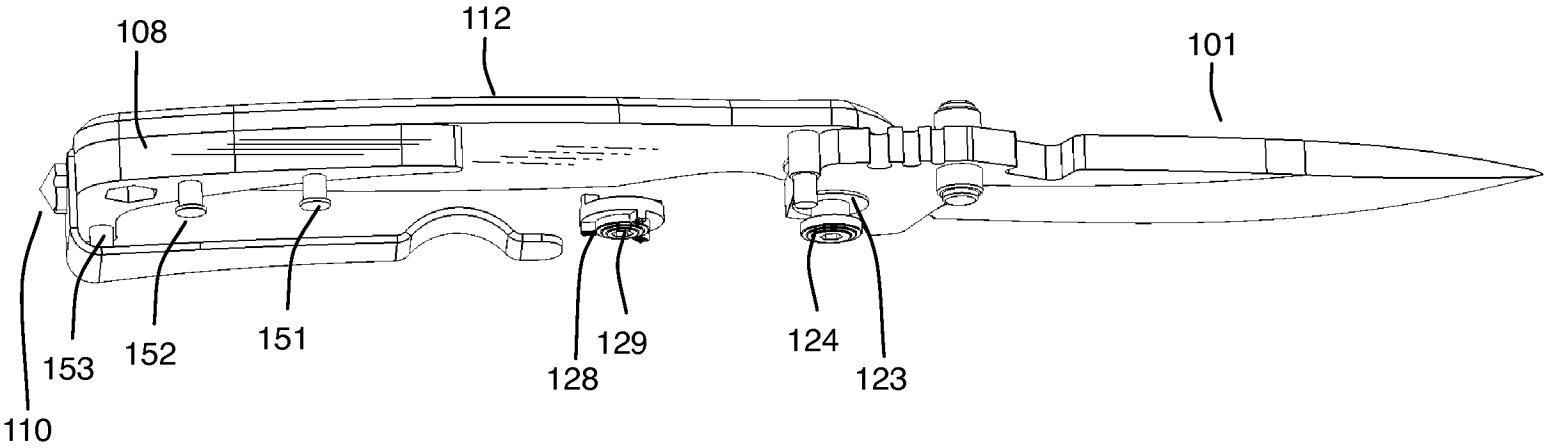
FIG. 12 illustrates a perspective top view of an embodiment of the invention without the locking handle to show the internal components of the knife.

FIG. 12 illustrates a perspective top view of an embodiment of the invention without the locking handle to show the internal components of the knife Screw sockets 151, 152 and 153 enable the locking handle to be screwed to the handle via the screws shown in FIG. 11, i.e., screws 141, 142 and 143 respectively. Also shown are pivot bolt 124 and second washer 123 that lie on opposing sides of the locking handle and which enable the blade to rotate from the open to folded orientation. Also shown are roto lock 128 and roto screw 129 wherein the roto lock rotates and keeps the locking element of the locking handle from extending outwardly, i.e., keeps the rear portion of the blade from rotating by ensuring the engagement of the locking element with the rear portion of the blade. Any type of locking mechanism may be utilized in any embodiment of the invention as desired.

Figure 13:
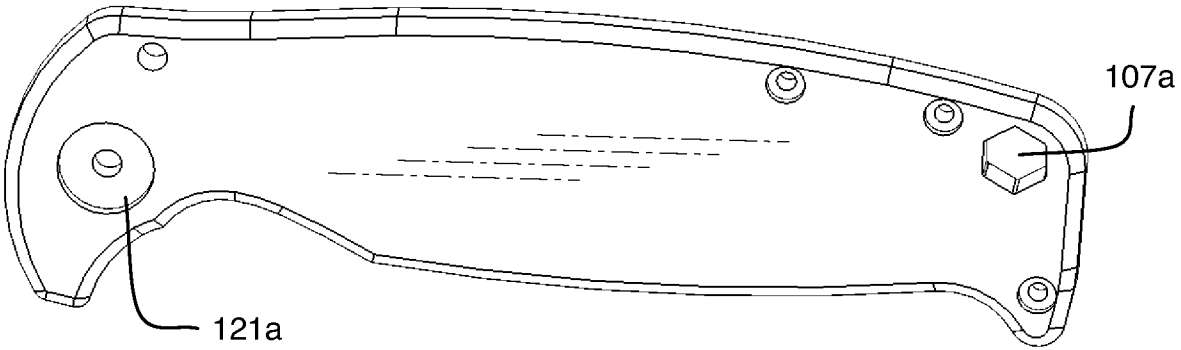
FIG. 13 illustrates a left side view of an embodiment of the handle.
Figure 14:
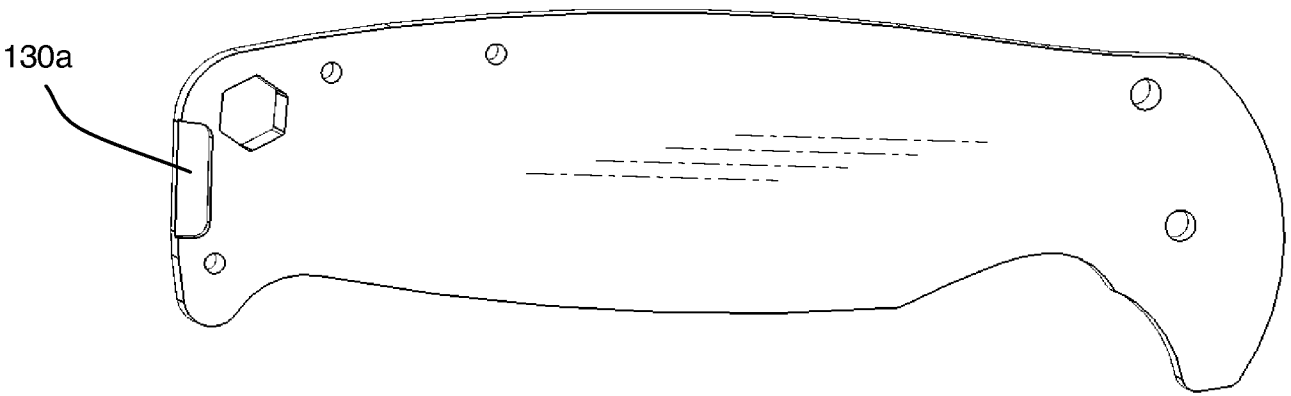
FIG. 14 illustrates a right side view of an embodiment of the handle, i.e., the inner portion of the handle.

FIG. 13 illustrates a left side view of an embodiment of the handle. As shown, hole 107*a* in the handle enables hole 107 in spacer 108 to engage a hex nut. Pivot nut indentation 121*a* provides an indented area for the pivot nut. FIG. 14 illustrates a right side view of an embodiment of the handle, i.e., the inner portion of the handle. Pocket clip indentation 130*a* provides an area for the end of the pocket clip to wrap into.

Figure 15:
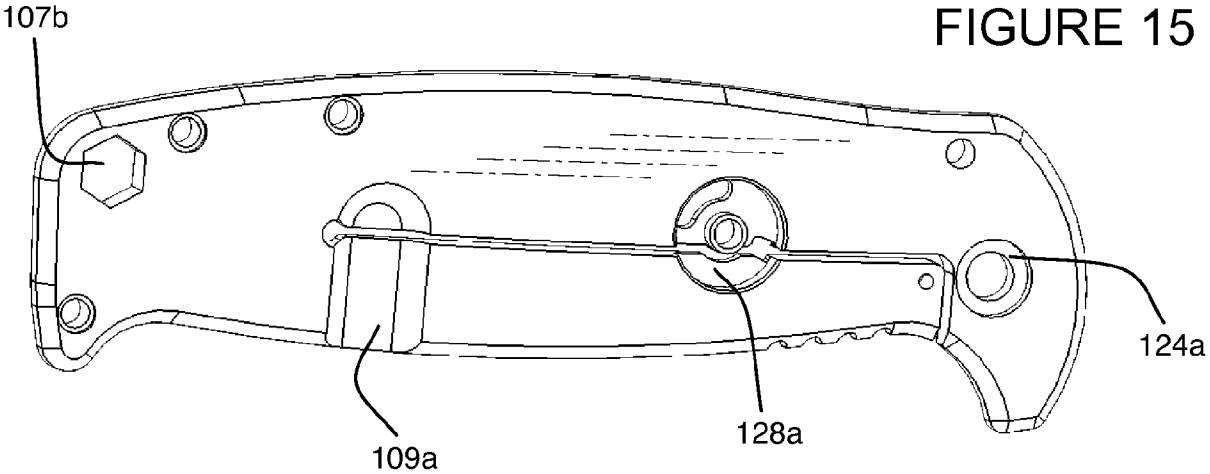
FIG. 15 illustrates a right side view of an embodiment of the locking handle.

FIG. 15 illustrates a right side view of an embodiment of the locking handle. As shown, indentation 109*a* provides for a thinner section of the locking element, which shown traveling to the right on the lower portion of the locking handle toward pivot bolt indentation 124*a*. The thinner section enables high strength material used to make the locking handle, such as titanium, to flex more. The locking element is generally set as a spring to extend inward when the blade rotation enables a flat portion of the blade to engage the rightmost portion of the locking element. Also shown in the locking handle is roto lock indentation 128*a*. Various other indentations for screws and screw sockets are optional and are not labeled for brevity.

Figure 16:
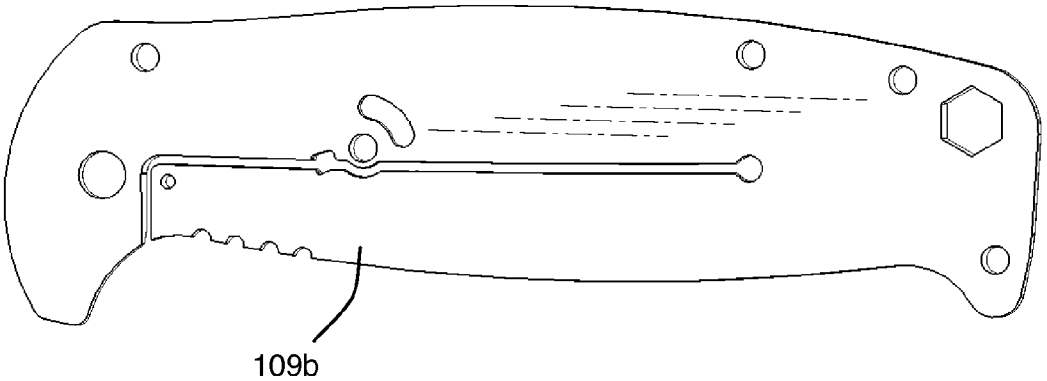
FIG. 16 illustrates a left side view of an embodiment of the locking handle, i.e., the inner portion of the locking handle.

FIG. 16 illustrates a left side view of an embodiment of the locking handle, i.e., the inner portion of the locking handle. The locking element 109*b* is shown as a long separate element with a flat face on the left portion and with knurling or jimping on the bottom left portion to enable firm engagement of a finger to push locking element 109*b* back into a parallel configuration, i.e., parallel to the upper portion of the locking handle, which enables the left portion of the locking element to clear the lower rear portion of the blade, which enables the blade to rotate to the folded orientation.

Figure 17:
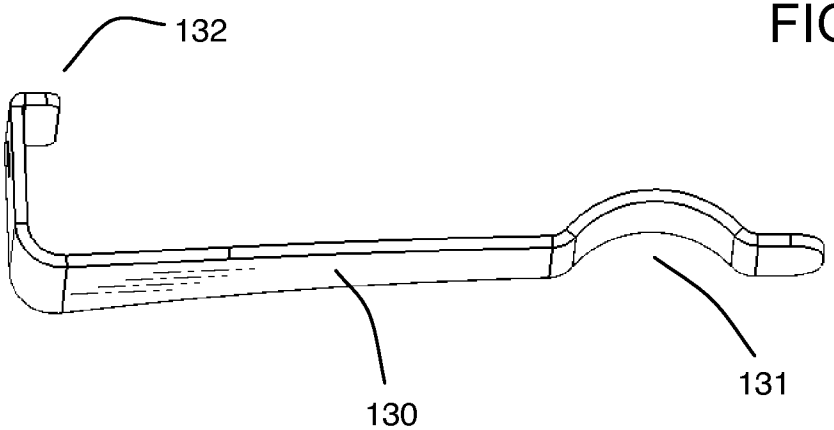
FIG. 17 illustrates a right side perspective view of an embodiment of the optional pocket clip.
Figure 18:
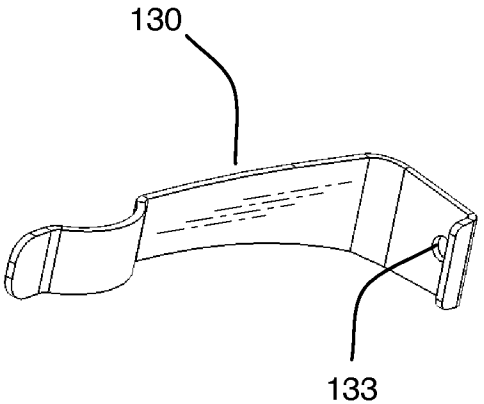
FIG. 18 illustrates a front perspective view of an embodiment of the optional pocket clip.

FIG. 17 illustrates a right side perspective view of an embodiment of the optional pocket clip. As shown, clip indentation 131 and clip engagement lip 132 are formed as curves in the pocket clip, for example during manufacture. FIG. 18 illustrates a front perspective view of an embodiment of the optional pocket clip. Hole 133 enables engagement of a lashing ring or first projection point, e.g., a glass breaker or pick or any other type of implement that may couple with the spacer.

Figure 19:
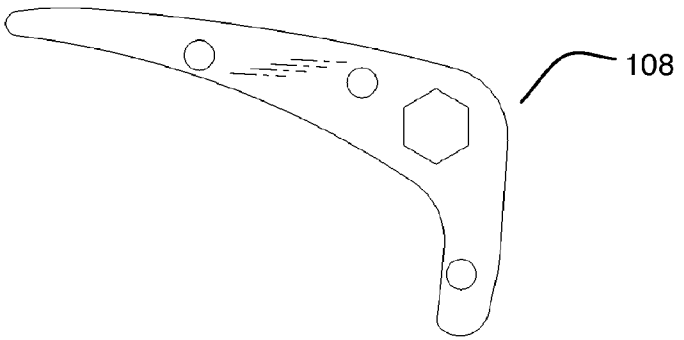
FIG. 19 illustrates a side view of a first embodiment of space 108.
Figure 20:
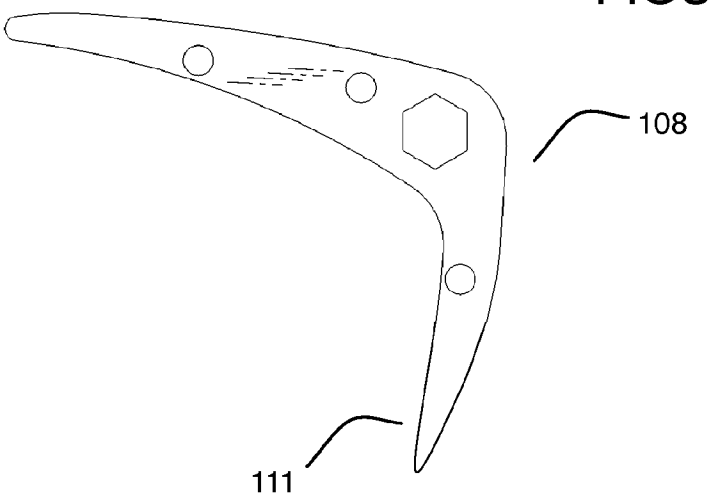
FIG. 20 illustrates a side view of a second embodiment of the spacer employing a second projection, which may be utilized as a scraper or pry bar.

FIG. 19 illustrates a side view of a first embodiment of space 108. FIG. 20 illustrates a side view of a second embodiment of the spacer employing second projection 111, which may be utilized as a scraper or pry bar. One or more embodiments of the invention include second pointed projection 111 coupled to the spacer that extends substantially perpendicular to a longest axis of the handle. The second pointed projection is known as a "pry bar", or "chisel", or "scraper". The second pointed projection is configured to extend between two objects to enable rotation of the knife to pry the two objects apart. The second pointed projection may also be used as a chisel by providing a force to the top portion of the distal end of the knife, directly above the downward pointing second pointed projection for example.

While the invention herein disclosed has been described by means of specific embodiments and applications thereof, numerous modifications and variations could be made thereto by those skilled in the art without departing from the scope of the invention set forth in the claims.

What is claimed is:

1. A folding survival knife with integrated tools comprising:

a blade having two substantially flat faces and a flat top, wherein the blade comprises a cutting edge on a first side of the blade where the two substantially flat faces meet and a non-cutting edge defined by the flat top that is located on a second side of the blade opposite the cutting edge;

wherein the non-cutting edge comprises an first indentation toward the cutting edge of the blade that is configured to engage a bottle cap on a top side of the bottle cap with a first portion of the first indentation and configured to engage a bottom edge of the bottle cap with an opposing side of the first indentation to enable removal of the bottle cap;

wherein the cutting edge comprises a second indentation configured to engage a wire to enable lateral angular movement of the blade to break the wire;

wherein the second indentation comprises a flat unsharpened portion;

wherein the first indentation and second indentation are indented toward one another to enable said blade to be lashed to another object with a line wrapped around said other object and said first indentation and said second indentation;

wherein the non-cutting edge further comprises jimping configured to provide a thumb grip on the non-cutting edge wherein the jimping is configured as two or more indentations of different size configured to grip wire insulation of different gauge to enable lateral translation movement of the blade to remove the wire insulation;

a hole configured to enable rotation of the blade;

a handle having a long axis and a short axis;

a locking handle configured to engage a bottom rear portion of said blade to lock said blade substantially parallel to the long axis of said handle;

a rotational coupling element coupled with said handle and configured to engage said hole in said blade;

a spacer;

wherein said rotational coupling element comprises a pivot bolt; and, wherein said rotational coupling element and said spacer are situated between the handle and locking handle and coupled to both said handle and locking handle wherein said spacer is further coupled with a first pointed projection that extends from an end of the handle on an opposite end with respect to said blade wherein the first pointed projection is configured to break glass.

2. The folding survival knife with integrated tools of claim 1 wherein said handle, said locking handle and said spacer each further comprise a hexagonal hole that is co-aligned wherein said hexagonal hole in said spacer is configured to engage a hex nut to enable rotation of the hex nut.

3. The folding survival knife with integrated tools of claim 1 wherein said spacer further comprises a second pointed projection coupled to the spacer and pointing at a right angle with respect to a longest axis of the handle wherein the second pointed projection is configured to scrape or to extend between two objects to pry the two objects apart.

4. The folding survival knife with integrated tools of claim 1 further comprising a pocket clip that couples with said spacer and is held in place by said first pointed projection.

5. The folding survival knife with integrated tools of claim 1 wherein said flat top is at least 3/16 of an inch wide.

6. The folding survival knife with integrated tools of claim 1 wherein said second indentation configured to engage said wire comprises a flat portion.

7. The folding survival knife with integrated tools of claim 1 wherein said hexagonal hole is located near a distal end of the handle area.

8. The folding survival knife with integrated tools of claim 1 wherein said first pointed projection is removably coupled to said spacer.

9. A folding survival knife with integrated tools comprising:

a blade having two substantially flat faces and a flat top wherein the blade comprises a cutting edge on a first side of the blade where the two substantially flat faces meet and a non-cutting edge defined by the flat top that is located on a second side of the blade opposite the cutting edge;

wherein the non-cutting edge comprises an first indentation toward the cutting edge of the blade that is configured to engage a bottle cap on a top side of the bottle cap with a first portion of the first indentation and configured to engage a bottom edge of the bottle cap with an opposing side of the first indentation to enable removal of the bottle cap;

wherein the cutting edge comprises a second indentation configured to engage a wire to enable lateral angular movement of the blade to break the wire;

wherein the second indentation comprises a flat unsharpened portion;

wherein the first indentation and second indentation are indented toward one another to enable said blade to be lashed to another object with a line wrapped around said other object and said first indentation and said second indentation;

wherein the non-cutting edge further comprises jimping configured to provide a thumb grip on the non-cutting edge wherein the jimping is configured as two or more indentations of different size configured to grip wire insulation of different gauge to enable lateral translation movement of the blade to remove the wire insulation;

a hole configured to enable rotation of the blade;

a handle having a long axis and a short axis;

a locking handle configured to engage a bottom rear portion of said blade to lock said blade substantially parallel to the long axis of said handle;

a rotational coupling element coupled with said handle and configured to engage said hole in said blade;

a spacer;

wherein said rotational coupling element comprises a pivot bolt; and, wherein said rotational coupling element and said spacer are situated between the handle and locking handle and coupled to both said handle and locking handle wherein said spacer is further coupled with a first pointed projection that extends from an end of the handle on an opposite end with respect to said blade wherein the first pointed projection is configured to break glass; and, wherein said handle, said locking handle and said spacer each further comprise a hexagonal hole through the frame that is configured to engage a hex nut to enable rotation of the frame about an axis defined by the hexagonal hole to rotate the hex nut.

10. The folding survival knife with integrated tools of claim 9 wherein said spacer further comprises a second pointed projection coupled to the spacer and pointing at a right angle with respect to a longest axis of the handle wherein the second pointed projection is configured to scrape or to extend between two objects to pry the two objects apart.

11. The folding survival knife with integrated tools of claim 9 further comprising a pocket clip that couples with said spacer and is held in place by said first pointed projection.

12. The folding survival knife with integrated tools of claim 9 wherein said flat top is at least 3/16 of an inch wide.

13. The folding survival knife with integrated tools of claim 9 wherein said second indentation configured to engage said wire comprises a flat portion.

14. The folding survival knife with integrated tools of claim 9 wherein said hexagonal hole is located near a distal end of the handle area.

15. The folding survival knife with integrated tools of claim 9 wherein said first pointed projection is removably coupled to said spacer.

16. A folding survival knife with integrated tools comprising:

a blade having two substantially flat faces and a flat top wherein the blade comprises a cutting edge on a first side of the blade where the two substantially flat faces meet and a non-cutting edge defined by the flat top that is located on a second side of the blade opposite the cutting edge;

wherein the non-cutting edge comprises an first indentation toward the cutting edge of the blade that is configured to engage a bottle cap on a top side of the bottle cap with a first portion of the first indentation and configured to engage a bottom edge of the bottle cap with an opposing side of the first indentation to enable removal of the bottle cap;

wherein the cutting edge comprises a second indentation configured to engage a wire to enable lateral angular movement of the blade to break the wire;

wherein the second indentation comprises a flat unsharpened portion;

wherein the first indentation and second indentation are indented toward one another to enable said blade to be lashed to another object with a line wrapped around said other object and said first indentation and said second indentation;

wherein the non-cutting edge further comprises jimping configured to provide a thumb grip on the non-cutting edge wherein the jimping is configured as two or more indentations of different size configured to grip wire insulation of different gauge to enable lateral translation movement of the blade to remove the wire insulation;

a hole configured to enable rotation of the blade;

a handle having a long axis and a short axis;

a locking handle configured to engage a bottom rear portion of said blade to lock said blade substantially parallel to the long axis of said handle;

a rotational coupling element coupled with said handle and configured to engage said hole in said blade;

a spacer;

wherein said rotational coupling element comprises a pivot bolt; and, wherein said rotational coupling element and said spacer are situated between the handle and locking handle and coupled to both said handle and locking handle wherein said spacer is further coupled with a first pointed projection that extends from an end of the handle on an opposite end with respect to said blade wherein the first pointed projection is configured to break glass;

wherein said handle, said locking handle and said spacer each further comprise a hexagonal hole through the frame that is configured to engage a hex nut to enable rotation of the frame about an axis defined by the hexagonal hole to rotate the hex nut; and, wherein said spacer further comprises a second pointed projection coupled to the spacer and pointing at a right angle with respect to a longest axis of the handle wherein the second pointed projection is configured to scrape or to extend between two objects to pry the two objects apart.

17. The folding survival knife with integrated tools of claim 16 wherein said flat top is at least 3/16 of an inch wide.

18. The folding survival knife with integrated tools of claim 16 wherein said second indentation configured to engage said wire comprises a flat portion.

19. The folding survival knife with integrated tools of claim 16 wherein said hexagonal hole is located near a distal end of the handle area.

20. The folding survival knife with integrated tools of claim 16 wherein said first pointed projection is removably coupled to said spacer.

21. A folding survival knife with integrated tools comprising:

a blade having two substantially flat faces and a flat top wherein the blade comprises a cutting edge on a first side of the blade where the two substantially flat faces meet and a non-cutting edge defined by the flat top that is located on a second side of the blade opposite the cutting edge;

wherein the non-cutting edge further comprises jimping configured to provide a thumb grip on the non-cutting edge wherein the jimping is configured as two or more indentations of different size configured to grip wire insulation of different gauge to enable lateral translation movement of the blade to remove the wire insulation;

a hole configured to enable rotation of the blade;

a handle having a long axis and a short axis;

a locking handle configured to engage a bottom rear portion of said blade to lock said blade substantially parallel to the long axis of said handle;

a rotational coupling element coupled with said handle and configured to engage said hole in said blade;

a spacer;

wherein said rotational coupling element comprises a pivot bolt; and, wherein said rotational coupling element and said spacer are situated between the handle and locking handle and coupled to both said handle and locking handle.

22. The folding survival knife with integrated tools of claim 21 wherein said spacer is further coupled with a first pointed projection that extends from an end of the handle on an opposite end with respect to said blade wherein the first pointed projection is configured to break glass.

23. The folding survival knife with integrated tools of claim 21 wherein the non-cutting edge comprises an first indentation toward the cutting edge of the blade that is configured to engage a bottle cap on a top side of the bottle cap with a first portion of the first indentation and configured to engage a bottom edge of the bottle cap with an opposing side of the first indentation to enable removal of the bottle cap;

wherein the cutting edge comprises a second indentation configured to engage a wire to enable lateral angular movement of the blade to break the wire;

wherein the second indentation comprises a flat unsharpened portion;

wherein the first indentation and second indentation are indented toward one another to enable said blade to be lashed to another object with a line wrapped around said other object and said first indentation and said second indentation.

* * * * *